United States Patent [19]

Hanaoka et al.

[11] 3,942,503

[45] Mar. 9, 1976

[54] COOLING SYSTEM FOR LUBRICATING OIL IN AN INTERNAL COMBUSTION ENGINE

[75] Inventors: Masanori Hanaoka, Toyota; Masao Inagaki, Okazaki, both of Japan

[73] Assignee: Toyota Jidosha Kogyo Kabushiki Kaisha, Japan

[22] Filed: June 13, 1974

[21] Appl. No.: 479,079

[30] Foreign Application Priority Data

Feb. 4, 1974 Japan ..... 49-13612

[52] U.S. Cl. .... 123/196 AB; 123/196 CP; 184/6.22

[51] Int. Cl.[2] ..... F01M 1/00

[58] Field of Search ... 123/196 AB, 196 R, 196 CP; 184/6.22, 104 B

[56] References Cited

UNITED STATES PATENTS

| | | | |
|---|---|---|---|
| 1,891,006 | 12/1932 | Norman | 123/196 AB |
| 1,906,538 | 5/1933 | Church | 123/196 AB |
| 2,680,433 | 6/1954 | Padova | 123/196 AB |
| 3,465,847 | 9/1969 | Donath | 123/196 AB |
| 3,493,081 | 2/1970 | Tado | 123/196 AB |

*Primary Examiner*—Charles J. Myhre
*Assistant Examiner*—Daniel J. O'Connor
*Attorney, Agent, or Firm*—Kenyon & Kenyon

[57] ABSTRACT

A cooling system for lubricating oil in an internal combustion engine is disclosed, said system comprising a pressure-regulating valve adapted for controlling the pressure in said system, said valve having a passageway means connecting it to an oil pump and other passageway means for diverting a part of said lubricating oil therethrough from said oil pump to an oil pan located at the bottom of said engine when the pressure in said system exceeds a predetermined value, said other passageway means extending to a position located adjacent to an upper portion of the inner surface of the front wall of the engine casing. Said other passageway means may be extended to a position facing the upwardly moving part of a timing chain which connects the crankshaft to the cam shaft.

5 Claims, 7 Drawing Figures

COOLING SYSTEM FOR LUBRICATING OIL IN AN INTERNAL COMBUSTION ENGINE

DESCRIPTION OF THE INVENTION

The present invention relates to a cooling system for lubricating oil in an internal combustion engine.

When driving an automobile at high speed, the temperature of the lubricating oil in the engine becomes extremely high. This high temperature makes it difficult to cool engine parts, and causes the lubricating oil to become low in viscosity. This lowering of viscosity makes it difficult to properly lubricate moving portions of the engine which, on certain occasions, may fuse together for example a piston and a cylinder.

To remedy the above-mentioned disadvantages an internal combustion engine has been proposed which has a separate cooling apparatus to cool the lubricating oil. Such an engine is effective in cooling the lubricating oil and, therefore, does remedy the above-mentioned disadvantages. However, such engine has other disadvantages in that it is too expensive to produce and requires extra space to mount the separate cooling apparatus.

An object of the present invention is to provide a cooling system to cool lubricating oil which is not expensive to produce.

Another object of the invention is to provide a system, as mentioned in the above object, which is capable of being simply mounted and which does not require a larger mounting space than that needed for conventional engines.

A further object of the invention is to provide said system, in which a part of the lubricating oil diverted from a pressure-regulating valve of an oil pump when the pressure in the system exceeds a predetermined value, is cooled and then, the entire lubricating oil is cooled by said part of the lubricating oil.

To satisfy the above objects one aspect of the present invention provides a cooling system for lubricating oil in an internal combustion engine, comprising:

an oil pump for circulation of lubricating oil, said pump being driven by the crankshaft of said engine, and a pressure-regulating valve adapted for controlling the pressure in said system, said valve having a passageway means connecting it to said oil pump and another passageway means for diverting a part of said lubricating oil therethrough from said oil pump to an oil pan located at the bottom of said engine when the pressure in said system exceeds a predetermined value, said other passageway means extending to a position located adjacent to an upper portion of the inner surface of the front wall of the engine casing, whereby said part of said lubricating oil flows downwardly along said inner surface of said wall of said engine casing.

In another aspect of the present invention there is provided a cooling system for lubricating oil in an internal combustion engine having a camshaft arranged above the crankshaft and at least one timing chain connecting a first timing pulley secured on said crankshaft to a second timing pulley secured on said camshaft, said system comprising:

an oil pump for circulation of lubricating oil, said pump being driven by said crankshaft, and a pressure-regulating valve adapted for controlling the pressure in said system, said valve having a passageway means connecting it to said oil pump and other passageway means for diverting a part of said lubricating oil therethrough from said oil pump to an oil pan located at the bottom of said engine when the pressure in said system exceeds a predetermined value, said other passageway means extending to a position facing the upwardly moving part of said timing chain, whereby said part of said lubricating oil is broken down under centrifugal force exerted by the rotation of said second timing pulley into fine particles which fall downwardly into said oil pan.

The above aspects of the present invention will be more apparent from the ensuing description with reference to the drawings wherein:

FIG. 1*a* is a sectional view of the inside of an internal combustion engine, provided with a cooling system for lubricating oil according to the invention;

FIG. 1*b* is a fragmentary view of FIG. 1*a*, but showing a modified arrangement of the top portion of the engine shown in FIG. 1*a;*

Figure 1A:
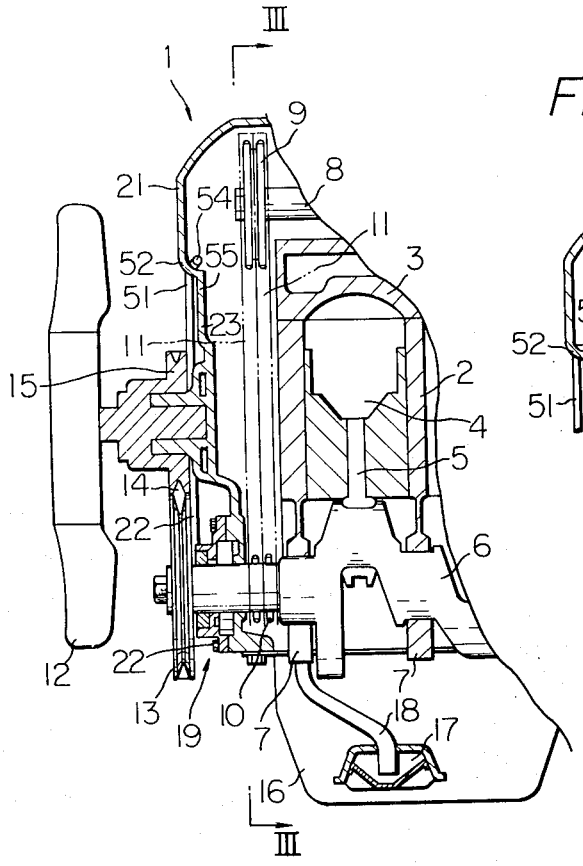

Referring to FIG. 1*a*, in order to describe the conventional oil circulation internal combustion engine, there is shown an Over-Head-Camshaft type internal combustion engine which has an engine casing 1 within which is provided a cylinder block 2 and a cylinder head 3. Arranged inside the cylinder block 2 are pistons 4, connecting rods 5 and a crankshaft 6 which is journaled by bearings 7.

A cam shaft 8 is rotatably mounted above the cylinder head 3. Timing pulleys 9 are secured to one end of the cam shaft 8, and other timing pulleys 10 are secured to the crankshaft 6. The pulleys 9 and 10 are interconnected by means of timing chains 11 so that the rotation of the crankshaft 6 is transmitted to the cam shaft 8. In order to cool the engine a fan assembly 12 which is driven by the crankshaft 6 through a pulley 13, a belt 14 and a pulley 15 is mounted in front of the engine casing 1. An oil pan 16 which stores lubricating oil which circulates in the engine is located at the bottom of the engine casing 1, the lubricating oil being supplied to the moving parts of the engine. An oil strainer 17 and a conduit 18 connected therewith are arranged inside the oil pan 16, the conduit 18 being adopted to feed the lubricating oil in the oil pan 16 to an oil pump for example a gear pump 19 mounted coaxially with the crankshaft 6.

Figure 2:
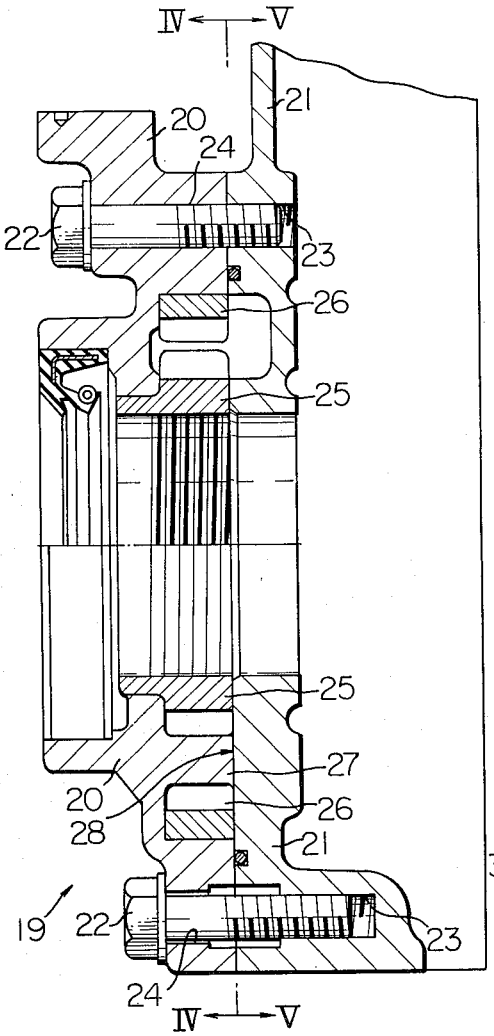
FIG. 2 is an enlarged view in section of the gear pump shown in FIG. 1*a;*
Figure 3:
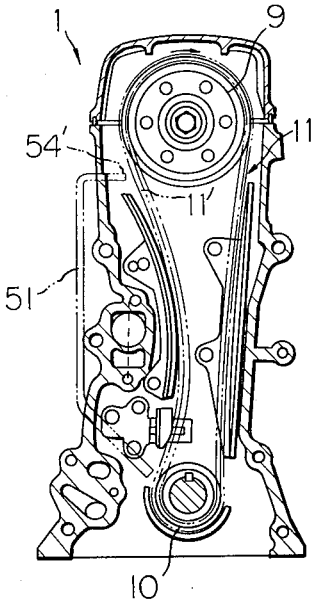
FIG. 3 is a sectional view taken along the line III—III in FIG. 1*b*.
Figure 4:
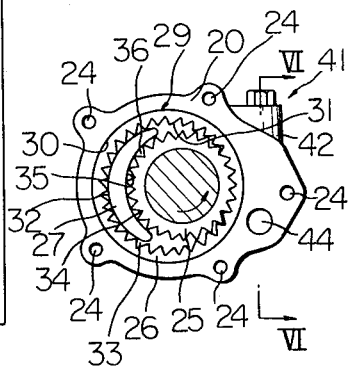
FIG. 4 is a reduced size sectional view taken along the line IV—IV in FIG. 2.
Figure 5:
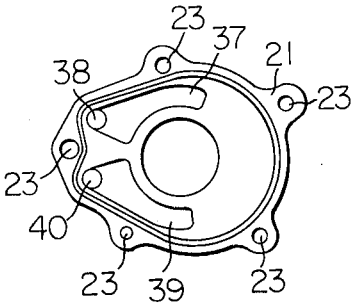
FIG. 5 is a reduced size sectional view taken along the line V—V in FIG. 2.

Referring now to FIGS. 2, 4 and 5, the gear pump 19 comprises a pump cover 20 secured to the front wall 21 of the engine casing 1 by means of bolts 22. The bolts 22 are screwed into threaded openings 23 in the front wall 21 through openings 24 in the cover 20.

Inside the pump cover 20, there is provided an outwardly toothed member 25, fitted to the crankshaft 6 by means of a spline engagement, and an inwardly toothed ring member 26 meshing with the outwardly toothed member 25 as shown in FIG. 4. A crescent-shaped guiding member 27 projecting from one side of the cover 20 abuts against the surface of the front wall 21 at a point 28. The outer surface 29 of the ring member 26 slidingly contacts the inner surface of the cover 20. The inner surface 31 of the ring member 26 slidingly contacts the outer surface 32 of the crescent-shaped guiding member 27, so that a plurality of partitions 33 are formed therebetween. The outer surface 34 of the outwardly toothed member 25 slidingly contacts the inner surface 35 of the crescent-shaped guiding member 27, so that a plurality of other partitions 36 formed therebetween.

Figure 1B:
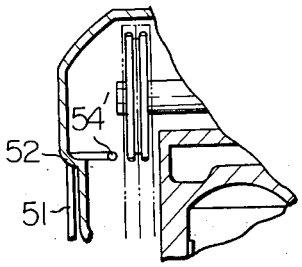

As is shown in FIG. 5, the front wall 21 has an inlet passageway 37 and an inlet port 38 communicated therewith, the inlet port 38 being communicated with the conduit 18 (shown in FIG. 1). The front wall 21 also has an outlet passageway 39 and an outlet port 40 communicated therewith, the outlet passageway 39 being communicated with a pressure regulating valve 41 (shown in FIG. 6).

Figure 6:
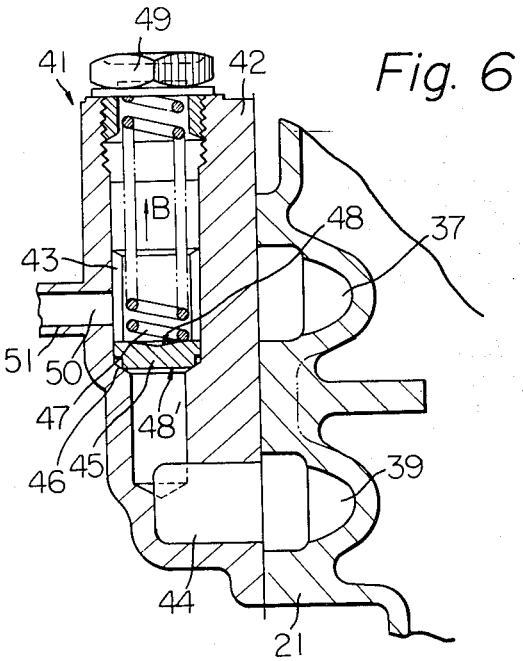
FIG. 6 is an enlarged sectional view taken along the line VI—VI in FIG. 4.

Referring to FIG. 6, the pressure-regulating valve 41 comprises a housing 42 formed integrally to the pump cover 20 (shown in FIG. 2). The housing 42 has a cylindrical bore 43 and a passageway 44 communicated with the passageway 39. A cylindrical valve member 45 is accommodated in the bore 43. The valve member 45 is urged against a shoulder 46 of the bore 43 by means of a spring 47, one end of which abuts against the upper surface 48 of the valve member 45, and the other end of which abuts against a stop 49 screwed to the upper end of the bore 43. The bore 43 is communicated with a conduit 51 through a passageway 50 defined in the housing 42.

The conventional circulation of the lubricating oil in the internal combustion engine described above is carried out as follows.

When the engine is running, the crankshaft 6 and the outwardly toothed member 25 connected therewith rotate in the direction A shown in FIG. 4, whereby the inwardly toothed member 26 meshing with the outwardly toothed member 25 rotates in the same direction. By this rotational movement, the lubricating oil in the oil pan 16 is sucked up to the inlet port 38 through the oil strainer 17 and the conduit 18. From the inlet port 38, the lubricating oil moves through the passageway 37 into the partitions 33 and 36, formed between crescent-shaped member and member 26 and member 25 respectively. The lubricating oil thus contained in the partitions 33 and 36 is conveyed to the outlet port 40, through the passageway 39, by the rotation of the member 25 in the direction A shown in FIG. 4.

The function of the pressure-regulating valve 41 is to control the pressure for circulation of the lubricating oil in the system so that it does not exceed a predetermined value when the engine has attained high speed. This is to protect the parts, for example the filter, of the lubricating system from the influence of high pressure. This control of the pressure of the lubricating oil is carried out as follows.

When the pressure of the lubricating oil in the passageway 39, caused by the rotation of the crankshaft 6, reaches a predetermined value, this pressure acts on the lower surface 48' of the valve member 45 through the passageway 44 so that the valve member 45 moves upwards, i.e., the direction B shown in FIG. 6, against the action of the spring 47. As a result of this, the passageway 39 is communicated with the passageway 50 through the passageway 44 and bore 43 (see FIG. 6). Therefore, a part of the lubricating oil is diverted from the passageway 39 through the conduit 51. From the conduit 51, the thus diverted oil returns to the oil pan 16 or inlet part of the gear pump 19. As a result of this, the pressure of the lubricating system is controlled.

The lubricating oil, thus pressure-controlled, is directed to and filtered through an oil filter (not shown) which is mounted outside of the engine casing 1.

The lubricating oil thus filtered again enters the engine casing 1, and is supplied to moving portions of the engine, for example, bearings 7 carrying the crankshaft 6, bearings (not shown) carrying the camshaft 8, and sliding surfaces between the cylinders and pistons 4. After this, the lubricating oil returns to the oil pan 16.

The conventional circulation of the lubricating oil in the lubricating system in an internal combustion engine is carried out as mentioned above. However, since the amount of the diverted oil from the pressure-regulating valve 41, which is returned to the oil pan 16 or to the inlet part of the gear pump 19, is large, for example 20 l/min at 5000 r. p. m., the inventors of the present invention investigated how this diverted oil could be used effectively. As a result of these investigations the present invention achieves effective use of this diverted oil. That is, as illustrated hereinafter, the principle of the present invention is that the diverted oil is cooled and, then, the entire lubricating oil is cooled by the cooled diverted oil.

According to the invention the passageway 50, to which is diverted a part of the lubricating oil from the passageway 39 of the gear pump 19 when the pressure in the lubricating system exceeds a predetermined value, is extended to a position located adjacent to the upper portion of the inner surface 55 of the front wall 21 of the engine casing 1. In the first embodiment of the present invention, as shown in FIG. 1a, the passageway 50 of pressure-regulating valve 41 is communicated with said position by means of a conduit 51, one end of which is communicated with the passageway 50 and the other end of which projects into the engine casing 1 through a connection means, for example, an aperture 52 defined in the upper portion of a side wall of the engine casing 1. The conduit 51 has an opening 54 located on the inner surface 55 of the front wall 21 of the engine casing 21. In such arrangement, diverted oil issuing from the opening 54 flows downwardly along the inner surface 55 of the front wall 21 of the engine casing 1 to the oil pan 16.

Since the front wall 21 is cooled by air flow caused by the rotation of the fan assembly 12, the diverted oil issuing from the opening 54 is cooled by flowing on the inner surface 55 of the front wall 21 so that the temperature of the diverted oil is substantially reduced.

As a result of this the lubricating oil in the oil pan 16 is effectively cooled, since the diverted lubricating oil is added to the lubricating oil which is stored in the oil pan 16.

To cool the lubricating oil more rapidly than described above, in a second embodiment shown in FIGS. **1*b* and 3 the opening 54' of the conduit 51 is so arranged that it faces the upwardly moving part 11' of the timing chains 11. In such an arrangement the diverted oil issuing from the outlet opening 54 is transported by the timing chains 11' to the timing pulleys 9, where the oil is broken down under centrifugal force exerted by the rotating timing pulleys 9, into fine particles which fall downwardly into the oil pan 16. When the lubricating oil is broken down into fine particles, the area of heat radiation of the lubricating oil becomes much larger than that of normal lubricating oil in the form of liquid, so that the temperature of the diverted oil is very much reduced. Consequently, when the cooled diverted oil is added to the oil in the oil pan 16** the temperature of the latter oil is substantially reduced. Based on experiments conducted using this embodiment the temperature of the lubricating oil of an engine can be lowered 5°C at 5000 r. p. m. compared to the temperature of lubricating oil in an engine not provided with the cooling system of the present invention.

Two embodiments have been described hereinbefore. However, many additional modifications of the present invention may be effected without departing from the scope and spirit of the invention. Some of these modifications are described hereinafter without reference to drawings.

1. In place of the conduit 51 of the above described embodiments a passageway means in the front wall 21 of the engine casing 1 may also be employed. One end of said passageway means would be communicated with the passageway 50 by a suitable connection means and the other end of said passageway means would be located on the upper portion of the front wall 21.

2. On the above described embodiments the oil pump, for example the gear pump 19, is arranged substantially coaxial with the crankshaft 6, however, an oil pump having a pressure-regulating valve may be arranged at a position located adjacent to the upper portion of the inner surface of the front wall of the engine casing 1. In such an arrangement, if the passageway 50 of the oil pump is facing the inner surface 55 of the front wall 21, the diverted oil will flow downwardly along the inner surface 55.

3. In the above described embodiments the engine is an Over-Head-Camshaft type, however, other types of engines may also be employed.

4. In the above described embodiments, the circulating system for the lubricating oil employs the gear pump 19 positioned substantially coaxial with the crankshaft 6. However, in place of such systems other types of systems may be employed, for example a system which employs a trochoid pump provided with a pressure-regulating valve, said trochoid pump being driven by a counter shaft connected to the crankshaft through timing chains.

What is claimed is:

1. In an internal combustion engine of the type having an oil pump for circulation of lubricating oil, said pump being driven by the crankshaft of said engine, and a pressure-regulating valve for control of the pressure in said system, said valve having one passageway means for communication with said oil pump and other passageway means for diverting a part of said lubricating oil therethrough from said oil pump to an oil pan located at the bottom of said engine when the pressure of said system exceeds a predetermined value, the improvement comprising:

a cooling system for the lubricating oil in which said other passageway means extends to a position located adjacent to the upper portion of the inner surface of the front wall of the engine casing for directing said part of said lubricating oil to flow downwardly along said inner surface of said relatively cool front wall of said engine casing.

2. In an internal combustion engine of the type having a crankshaft, a camshaft arranged above the crankshaft, at least one timing chain connecting a first timing pulley secured on said crankshaft to a second timing pulley secured on said camshaft, an oil pump for circulation of lubricating oil, said pump being driven by said crankshaft, and a pressure-regulating valve for control of the pressure in said system, said valve having one passageway means for diverting a part of said lubricating oil therethrough from said oil pump to an oil pan located at the bottom of said engine when the pressure in the system exceeds a predetermined value, the improvement comprising:

a cooling system for the lubricating oil in which said other passageway means extends to a position facing the upwardly moving part of said timing chain for directing said part of said lubricating oil onto said chain to be dispersed into fine particles by the centrifugal force exerted by said rotating second timing pulley said fine particles being cooled as they fall downwardly into said oil pan.

3. A cooling system according to claim 2, wherein said engine is an overhead camshaft type engine.

4. A cooling system according to claim 1, wherein said other passageway means is a conduit means one end of which communicates with said one passageway means only when the pressure of said system exceeds said predetermined value, and the other end of which projects into said engine casing through a connection means mounted on a portion of said engine casing.

5. A cooling system according to claim 2, wherein said other passageway means is a conduit means, one end of which may communicate with said one passageway means only when the pressure of said system exceeds said predetermined value, and the other end of which projects into said engine casing through a connection means mounted on a portion of said engine casing.

* * * * *